US006208366B1

(12) United States Patent
Aoyama

(10) Patent No.: US 6,208,366 B1
(45) Date of Patent: Mar. 27, 2001

(54) OPTICAL HEAD HAVING FUNCTION OF DETECTING POSITIONAL DISPLACEMENT OF PHOTOSENSITIVE MEMBER AND ELECTROPHOTOGRAPHIC IMAGE FORMING APPARATUS EMPLOYING THE SAME

(75) Inventor: Kazumi Aoyama, Kashiwazaki (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/253,861

(22) Filed: Feb. 22, 1999

(30) Foreign Application Priority Data

Feb. 25, 1998 (JP) ..... 10-043482

(51) Int. Cl.[7] ..... B41J 2/47
(52) U.S. Cl. ..... 347/234; 347/248
(58) Field of Search ..... 347/234, 248, 347/238, 241, 229, 244, 256, 134, 130; 257/88, 98

(56) References Cited

FOREIGN PATENT DOCUMENTS 61-138265 6/1986 (JP) .
4-16969 1/1992 (JP) .
4-9975 1/1992 (JP) .

*Primary Examiner*—N. Le
*Assistant Examiner*—Lamson D. Nguyen
(74) *Attorney, Agent, or Firm*—Ostrolenk, Faber, Gerb & Soffen, LLP

(57) ABSTRACT

The invention provides an optical head which provides between a photosensitive member and a position detector a sufficient distance over which the photosensitive member and the position detector are not brought into contact with each other readily by thermal expansion of the apparatus or a like cause. The optical head includes a latent image forming light emitting element array for irradiating light upon a photosensitive belt to form an electrostatic latent image on the photosensitive belt, a position detecting light emitting element array for irradiating light to be used for detection of the position of an end portion of the photosensitive belt, a position detector for detecting the position of the end portion of the photosensitive member from the light emitted from the position detecting light emitting element array, and an exposure position correction section for varying an electrostatic latent image formation position of the latent image forming light emitting array in response to the position of the end portion of the photosensitive member detected by the position detector. The focal length of a rod lens array for the position detecting light emitting element array is set longer than that of a rod lens array for the latent image forming light emitting element array.

9 Claims, 2 Drawing Sheets

OPTICAL HEAD HAVING FUNCTION OF DETECTING POSITIONAL DISPLACEMENT OF PHOTOSENSITIVE MEMBER AND ELECTROPHOTOGRAPHIC IMAGE FORMING APPARATUS EMPLOYING THE SAME

BACKGROUND OF THE INVENTION

1. Field of the Invention

The present invention relates to a light emitting diode (LED) head having a function of detecting positional displacement of a photosensitive member and an electrophotographic image forming apparatus employing the same, and more particularly to an LED head having a function of detecting positional displacement of a photosensitive member and an electrophotographic image forming apparatus employing the same which are suitable for use with an electrophotographic color printing apparatus.

2. Description of the Related Art

Conventionally, an LED head having a function of detecting positional displacement of a photosensitive member of the type mentioned employs, as disclosed in, for example, in Japanese Patent Laid-Open No. 9975/1992, a writing light source in the form of an array such as an LED array which is used also as a light source for detection of the position of a photosensitive member and uses a photodiode as a position detector for the photosensitive member.

FIG. 2 schematically shows a construction of such a conventional LED head as described above. Referring to FIG. 2, the LED head 1 shown includes a position detecting LED array 4 for emitting light to position detector 3, a latent image forming LED array 5 for irradiating light upon a photosensitive belt 2, and a single rod lens array 8. Therefore, photosensitive belt 2 and position detector 3 must be disposed within a range of a focal length of the rod lens array 8. Usually, the range of the focal length is 0.2 mm or less. Actually, since the photosensitive belt 2 has some thickness, a gap 9 between the photosensitive belt 2 and the position detector 3 is smaller than 0.2 mm. The photosensitive belt 2 and the position detector 3 disposed with such a small gap left therebetween are brought into contact with each other readily, for example, by thermal expansion of them by a temperature variation or an impact upon the apparatus by an operator. Such contact between them gives rise to formation of a defective image because toner powder on the photosensitive belt 2 is scattered to damage an image or the speed of movement of the photosensitive belt 2 is dropped to cause partial contraction of an image.

Thus, the conventional LED head having such a function of detecting positional displacement of a photosensitive member as described above is disadvantageous in that, as the photosensitive member and the position detector are brought into contact with each other by thermal expansion of the apparatus or by some other cause, a defective image is produced because toner powder on the photosensitive member is scattered to damage an image or the speed of movement of the photosensitive member is dropped to cause partial contraction of an image.

The reason is that, because the rod lens array of the LED head has an equal focal length between a portion thereof which is used for detection of the position of the photosensitive member and another portion thereof which is used to write a latent image and besides the range of the focal length of the rod lens array is narrow, the photosensitive member and the position detector must be disposed within the narrow range of the focal length.

SUMMARY OF THE INVENTION

It is an object of the present invention to provide an optical head which provides between a photosensitive member and a position detector a sufficient distance over which the photosensitive member and the position detector are not brought into contact with each other readily by thermal expansion of the apparatus or a like cause and an electrophotographic image forming apparatus which employs the optical head.

In order to attain the object described above, according to an aspect of the present invention, there is provided an optical head having a function of detecting positional displacement of a photosensitive member, comprising a latent image forming light emitting element array for irradiating light upon the photosensitive member to form an electrostatic latent image on the photosensitive member, a position detecting light emitting element array for irradiating light to be used for detection of the position of an end portion of the photosensitive member, a position detector for detecting the position of the end portion of the photosensitive member from the light emitted from the position detecting light emitting element array, and exposure position correction means for varying an electrostatic latent image formation position of the latent image forming light emitting array in response to the position of the end portion of the photosensitive member detected by the position detector, a rod lens array for the position detecting light emitting element array having a focal length longer than a focal length of a rod lens array for the latent image forming light emitting element array.

Preferably, the latent image forming light emitting element array and the position detecting light emitting element array are formed on a same board. Each of the latent image forming light emitting element array and the position detecting light emitting element array may be an LED array.

According to another aspect of the present invention, the optical head described above can be used suitably as exposure means for exposing the photosensitive member to light in an electrophotographic image forming apparatus. Preferably, the photosensitive member is in the form of a belt.

With the optical head and the photoelectric image forming apparatus, since the position detector and the photosensitive member are not brought into contact with each other even if, for example, thermal expansion of the apparatus by a temperature variation occurs or an impact by operation of an operator acts upon the apparatus, such an image defect that toner powder on the photosensitive member is scattered by inadvertent contact between the position detector and the photosensitive member to damage an image or the speed of movement of the photosensitive member is dropped to cause partial contraction of an image does not occur.

The reason is that, because the focal length of the position detecting rod lens array is longer than the focal length of the latent image forming rod lens array, a sufficient gap can be assured between the position detector and the photosensitive member, and consequently, inadvertent contact between the position detector and the photosensitive member does not occur.

The above and other objects, features and advantages of the present invention will become apparent from the following description and the appended claims, taken in conjunction with the accompanying drawings in which like parts or elements are denoted by like reference symbols.

DESCRIPTION OF THE PREFERRED EMBODIMENT

Figure 1:
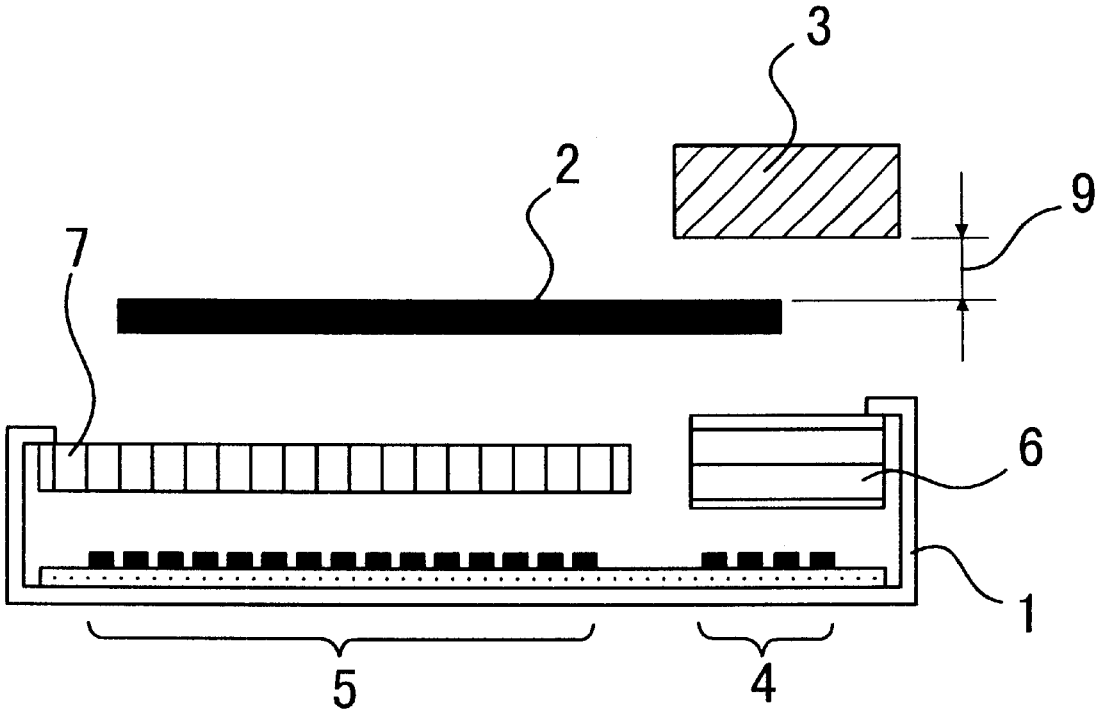
FIG. 1 is a schematic view showing a construction of an optical head to which the present invention is applied.
Figure 2:
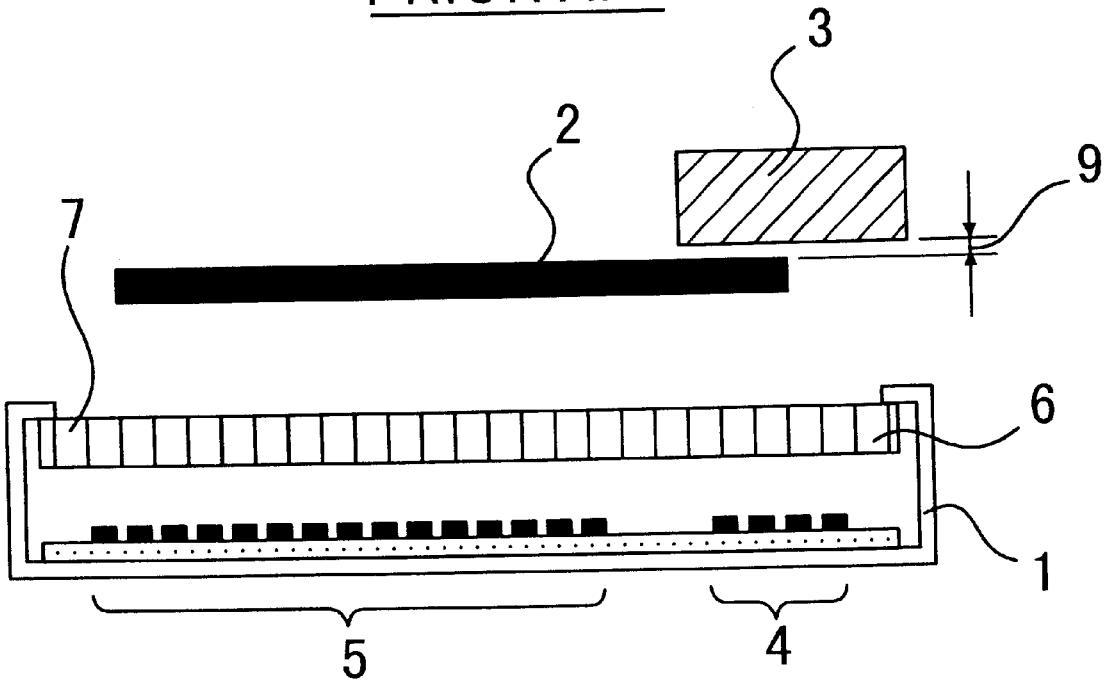
FIG.2 PRIOR ART
FIG. 2 is a similar view but showing a construction of a conventional optical head.

Referring to FIG. 1, there is shown an optical head to which the present invention is applied. The optical head has a function of detecting positional displacement of a photosensitive member and is shown incorporated in an electrophotographic color image forming apparatus. The optical head includes an LED head 10 which irradiates light on a photosensitive belt 2 of the electrophotographic color image forming apparatus to form an electrostatic latent image on the photosensitive belt 2, and a position detector 3 for detecting light emitted from the LED head 10 to detect the position of the photosensitive belt 2.

The LED head 10 includes a position detecting LED array 4 for emitting light to the position detector 3, a position detecting rod lens array 6 for focusing the light emitted from the position detecting LED array 4 at the position detector 3, a latent image forming LED array 5 for irradiating light upon the photosensitive belt 2 (exposing the photosensitive belt 2 to light) to form an electrostatic latent image on the photosensitive belt 2, a latent image forming rod lens array 7 for focusing the light emitted from the latent image forming LED array 5 at the photosensitive belt 2, and an exposure position correction section not shown for varying a latent image writing position of the latent image forming LED array 5 in response to an end position of the photosensitive belt 2 detected by the position detector 3.

It is assumed that the latent image forming rod lens array 7 for focusing light emitted from the latent image forming LED array 5 at the photosensitive belt 2 is formed from a rod lens array whose focal length is 5 to 5.2 mm. On the other hand, it is assumed that the position detecting rod lens array 6 for focusing light emitted from the position detecting LED array 4 at the position detector 3 is formed from a rod lens array whose focal length is 10 to 10.2 mm. In this instance, the difference between the focal lengths of the latent image forming rod lens array 7 and the position detecting rod lens array 6 is 4.8 mm or more, and consequently, a gap 9 sufficient to prevent contact between the position detector 3 and the photosensitive belt 2 can be assured. As a result, such an image defect that toner powder on the photosensitive belt 2 is scattered by inadvertent contact between the position detector 3 and the photosensitive belt 2 to damage an image or the speed of movement of the photosensitive belt 2 is dropped to cause partial contraction of an image does not occur.

Since, as a position detecting rod lens array for detection of the position of a photosensitive member, a rod lens array having a focal length longer than a latent image forming rod lens array in this manner is used, a position detector for detecting the position of the photosensitive member from light from an LED head and the photosensitive member can be disposed at positions spaced away from each other. Consequently, such an image defect that toner powder on the photosensitive belt is scattered by inadvertent contact between the position detector and the photosensitive member to damage an image or the speed of movement of the photosensitive member is dropped to cause partial contraction of an image does not occur.

The electrostatic latent image formed on the photosensitive belt 2 is thereafter converted into a visible image by known color image formation processing.

While a preferred embodiment of the present invention has been described using specific terms, such description is for illustrative purpose only, and it is to be understood that changes and variations may be made without departing from the spirit or scope of the following claims.

What is claim is:

1. An optical head having a function of detecting positional displacement of a photosensitive member, comprising:

a latent image forming light emitting element array for irradiating light upon said photosensitive member for forming an electrostatic latent image on said photosensitive member;

a position detecting light emitting element array for irradiating light to be used for detection of the position of an end portion of said photosensitive member;

a position detector for detecting the position of the end portion of said photosensitive member from the light emitted from said position detecting light emitting element array;

a rod lens array for said latent image forming light emitting element array having a first focal length; and a rod lens array for said position detecting light emitting element array having a second focal length longer than the first focal length.

2. An optical head having a function of detecting positional displacement of a photosensitive member as claimed in claim 1, wherein said latent image forming light emitting element array and said position detecting light emitting element array are formed on a same board.

3. An optical head having a function of detecting positional displacement of a photosensitive member as claimed in claim 2, wherein each of said latent image forming light emitting element array and said position detecting light emitting element array is an LED array.

4. An electrophotographic image forming apparatus, comprising:

a photosensitive member; and an optical head serving as exposure means for exposing said photosensitive member to light;

said optical head including a latent image forming light emitting element array for irradiating light upon said photosensitive member to form an electrostatic latent image on said photosensitive member, a position detecting light emitting element array for irradiating light to be used for detection of the position of an end portion of said photosensitive member, a position detector for detecting the position of the end portion of said photosensitive member from the light emitted from said position detecting light emitting element array, a rod lens array for said latent image forming light emitting element array having a first focal length; and a rod lens array for said position detecting light emitting element array having a second focal length longer than the first focal length.

5. An electrophotographic image forming apparatus as claimed in claim 4, wherein said latent image forming light emitting element array and said position detecting light emitting element array are formed on a same board.

6. An electrophotographic image forming apparatus as claimed in claim 5, wherein each of said latent image forming light emitting element array and said position detecting light emitting element array is an LED array.

7. An electrophotographic image forming apparatus as claimed in claim 6, wherein said photosensitive member is in the form of a belt.

8. An electrophotographic image forming apparatus as claimed in claim 5, wherein said photosensitive member is in the form of a belt.

9. An electrophotographic image forming apparatus as claimed in claim 4, wherein said photosensitive member is in the form of a belt.

* * * * *